US006462643B1

(12) United States Patent
Fujii et al.

(10) Patent No.: US 6,462,643 B1
(45) **Date of Patent: *Oct. 8, 2002**

(54) PTC THERMISTOR ELEMENT AND METHOD FOR PRODUCING THE SAME

(75) Inventors: Eiji Fujii, Hirakata; Hideo Torii, Higashiosaka; Atsushi Tomozawa, Osaka, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/250,731

(22) Filed: Feb. 16, 1999

(30) Foreign Application Priority Data

Feb. 16, 1998 (JP) ..... 10-032455
Feb. 16, 1998 (JP) ..... 10-032456
Feb. 17, 1998 (JP) ..... 10-034538

(51) Int. Cl.[7] ..... H01C 7/10; H01C 7/13

(52) U.S. Cl. ..... 338/225 D; 338/22 R; 338/34

(58) Field of Search ..... 338/22 R, 225 D, 338/25, 34, 35, 254, 255, 48

(56) References Cited

U.S. PATENT DOCUMENTS 3,673,538 A * 6/1972 Faxon ..... 338/25
3,811,938 A * 5/1974 Hirose et al. ..... 117/224
3,878,501 A * 4/1975 Moorhead et al. ..... 338/22 R
4,223,208 A * 9/1980 Kleinschmidt et al. ..... 219/3
4,716,279 A * 12/1987 Hori et al. ..... 219/541
5,394,288 A * 2/1995 Nishida et al. ..... 361/31
5,592,647 A * 1/1997 Yamauchi et al. ..... 392/432
5,688,424 A * 11/1997 Asaida ..... 219/531
5,805,049 A * 9/1998 Yamada et al. ..... 338/25

FOREIGN PATENT DOCUMENTS

JP 2-77102 3/1990

OTHER PUBLICATIONS

Electronic Ceramic, (Sep. 1987) pp. 28–33.

* cited by examiner

*Primary Examiner*—Elvin Enad
*Assistant Examiner*—Kyung S. Lee
(74) *Attorney, Agent, or Firm*—McDermott, Will & Emery

(57) ABSTRACT

The present invention provides a PTC thermistor element low in electric resistance at room temperature and suitable for monolithic incorporation with an integrated circuit. According to the present invention, the PTC thermistor film is subjected to rapid heating by heat irradiation in the annealing step. An n-type semiconductor is interposed between the electrodes and the PTC thermistor film, and a PTC thermistor film is also interposed between the n-type semiconductor and the electrode. Further, a plurality of such thermistor elements are parallel-connected to each other, and at least one of them is connected opposite to the other elements.

11 Claims, 9 Drawing Sheets

PTC THERMISTOR ELEMENT AND METHOD FOR PRODUCING THE SAME

BACKGROUND OF THE INVENTION

The present invention relates to PTC thermistor elements used in switching elements for example. and methods for producing the same.

Barium tltanate-type ceramics have been widely used as a material for ceramic filters and capacitors because of the high resistivity and dielectric constant. Also, barium titanate-type semiconductors, which contains a small amount of rare earth elements or the like as a dopant, have been used in temperature sensor elements and switching elements as a positive temperature coefficient (PTC) thermistor due to their PTC characteristics or the characteristic that the electric resistance thereof undergoes a sudden change around the Curie point where a phase transition occurs between the ferroelectric phase and the paraelectric phase.

In recent years, there has a proposal of an application of semiconductor film in the PTC thermistor element, in place of a bulk or sintered block of the semiconductor in a conventional PTC thermistor element. Such application of the thin PTC thermistor film enables the element a decrease in heat capacity thereof and Improvement in response characteristic. Further, such application of film could improve the quality and reliability of small-sized PTC elements since control in thickness of the film in producing process can be better exercised than in fine working of the condenser bulk. Another advantage is that the film is excellent in mechanical strength.

The film PTC thermistor is opening up various new possibilities including monolithic incorporation of thermistor elements on an Integrated circuit.

A typical PTC thermistor element using the film is shown in FIG. 10.

As shown in FIG. 10, the film PTC thermistor element has an insulating substrate 53, a PTC thermistor film 52 of barium titanate-type semiconductor formed thereon, and a pair of comb-shaped electrodes 51*a* and 51*b* made of aluminum films formed on the PTC thermistor film 52.

The barium titanate-type semiconductor film is generally formed by the sputtering method. The sputtering technique can control a quantity of rare earth elements such as Sr, Mn and Y to be added to impart PTC characteristlcs to the film better than the vacuum deposition method or the chemical vapor deposition (CVD) method.

An addition of Sr, Sn, Zr or Pb changes the temperature at which the film sharply changes in resistance An addition of Y, Nb, Ta, Si, Sb, W. La, Ce, Pr, Nd, Sm, Gd or Ho makes the film semiconductive up to the inside of the crystal grain An addition of Mn, Fe, Cu or Cr Increases the change ratio in electric resistance with temperature rise. An addition of Si makes crystal grains in the film uniform in diameter The PTC thermistor element is produced as the following process, for example.

First, the PTC thermistor film 52 is formed on the alumina substrate 53 by the sputtering technique, followed by heat treatment for three hours at 1.000° C.

Then, the comb-shaped electrodes 51*a* and 51*b* is formed on the surface of thus formed PTC thermistor film 52. Here, single base metals such as Al, Ni, Cu, Au, In, Ag, Hg, Ga or Zn and their alloys, which can have an ohmic contact with the PTC thermistor film 52, are employed as the materials of the comb-shaped electrodes 51*a* and 51*b*.

Those electrodes 51*a* and 51*b* are formed by such techniques as vacuum deposition, printing, plating and sputtering.

If noble metals such Pt excellent in high-temperature durability are used in place of the aforesaid base metals, a shottky barrier which sends up the apparent electric resistance of the element will be inevitably formed and no ohmic contact will be produced between the PTC thermistor film and electrode.

There is a growing demand for film PTC thermistor elements. But such elements are too high in electric resistance to build in the integrated circuit.

The electric resistance of PTC thermistor element at room temperature is decreased when the thickness of the PTC thermistor film is increased. But, a PTC thermistor film as thick as tens of microns formed on a substrate would peel off from the substrate because of an internal stress thereof. That is, a firmly formed film would have a thickness of only several microns.

As a solution to that problem, a PTC thermistor element as shown in FIG. 1 has been proposed. This thermistor element has an electrode 2 formed on the surface of an insulating substrate 1, and a PTC thermistor film 3 and the other electrode 4 formed thereon. It is hoped that adopting such a lamination structure In which a PTC thermistor film is sandwiched between a pair of electrodes could lower the electric resistance of the element.

However, the PTC thermistor element of that lamination structure falls to exhibit fully desired characteristics on the following ground.

That is, to form a PTC thermistor film by the sputtering technique, it is necessary to raise the substrate temperature in forming a film and the subsequent heat treatment temperature up to 800° C. or higher as described in "Electronic Ceramics" (Sep. 1987, p. 28 to 33) and Japanese Laid-Open Patent Publication No. Hei 2-77102 . The electrode 2 to be formed before the PTC thermistor film 3 is exposed to that high temperature for one hour or more. Base metals used as the electrode material are oxidized at that high temperature, losing the dielectric constant or diffusing into the PTC thermistor film and deteriorating the PTC characteristics of the formed film.

An object of the present invention is to solve the above-mentioned problems thereby to provide a PTC thermistor element with excellent PTC thermistor characteristics.

BRIEF SUMMARY OF THE INVENTION

The method for making a PTC thermistor element of the present invention comprises the steps of: forming a first electrode on an insulating substrate; forming a PTC thermistor film containing barium titanate as a main component on the first electrode; heat-treating the substrate; and forming a second electrode on the film, wherein the heat treatment of the substrate is rapid heating using a heat irradiation.

In making a PTC thermistor element, a first electrode, PTC thermistor film and second electrode are formed on the substrate in this order. Therefore, it is observed that the material contained in the first electrode diffuses into the PTC thermistor film at forming the PTC thermistor film on the first electrode, or at annealing the formed PTC thermistor film. As a result, the PTC thermistor film fails to develop a perovskite crystal structure and to exhibit the desired characteristics.

The diffusion of the electrode material depends on the temperature and time of the heat treatment of the PTC thermistor film. Therefore, the diffusion into the PTC thermistor of the electrode material can be kept down when the PTC thermistor is heated rapidly and then cooled in a short time thereby to shorten the time in which the electrode is exposed to a high temperature.

Preferably, the maximum temperature of the substrate in the heat treatment is set in a range of 900 to 1,500° C., and the time of treatment including the heating and cooling is set at 0.5 to 5 minutes. The preferable treatment time depends on the diffusion rate of the electrode material at the maximum temperature. If the heating In one session of the above treatment is not enough for developing the desired PTC thermistor characteristics, the heating under the same conditions may be repeated a number of times For example, in a case of Ni as the electrode material, one heat treatment for 300 seconds is enough at 900° C., but a repetition of five times of the heat treatment for 30 seconds is desired at 1,500° C. With Al, it is desirable to conduct the heat treatment for 30 seconds at 900° C. for 20 times.

It is desirable to use a lamp heater for the rapid heating of the substrate.

A PTC thermistor element of the present invention includes: a barium titanate-containing PTC thermistor film; an n-type semiconductor connected to the PTC thermistor film; a first electrode connected to the PTC thermistor film; and a second electrode connected to the n-type semiconductor.

In an example of making the PTC thermistor element, the PTC thermistor film is formed on a surface of a substrate made of n-type semiconductor, and a pair of the electrodes are then formed on each side of the substrate so as to sandwich the substrate and the PTC thermistor film formed thereon therebetween. The pair of electrodes may also be formed on the same side. In this case, an insulating substrate provided with an n-type semiconductor film on the surface may be used in place of the substrate of n-type semiconductor.

An n-type semiconductor placed between the PTC thermistor film and the electrodes would work as a part of the electrode. Even if, therefore, valiances are observed in workmanship and electric characteristics, the PTC thermistor characteristics of the element are hardly influenced as a whole. Further, no shottky barrier will be formed between the PTC thermistor film and the n-type semiconductor.

The n-type semiconductor may be a semiconductor formed with the barium titanate of the perovskite-type crystal structure as a main component. Alternatives may be semiconductors with the main component being Si, zinc oxide, titanium oxide, iron oxide, tin oxide, etc.

Under the above-mentioned arrangement, electrodes can be formed after a PTC thermistor film being formed. Therefore, the heat treatment of the PTC thermistor film can be performed at a high temperature and a film of a higher quality can be obtained. Besides, it is possible to prevent the electrode material from diffusing into the PTC thermistor film. Thus, the present invention can provide a PTC thermistor element which is low in electric resistance at room temperature.

The suitable electrode materials include aluminum, nickel, zinc, copper, silver, In—Ga and In—Hg. Another PTC thermistor element of the present invention has a plurality of PTC thermistor units, each provided with a PTC thermistor film containing barium titanate as well as a pair of electrodes, all the PTC thermistor units parallel-connected to each other, with at least one of them connected In reverse manner.

If a noble metal is used for the electrode, a shottky barrier will be formed between the PTC thermistor film and the electrode, exhibiting diode-like rectification characteristics. Therefore, when a plurality of PTC thermistor units are parallel-connected to each other and at least one of them is connected to the others in reverse manner, the rectification characteristics can be offset, and thus a PTC thermistor element with a low electric resistance at room temperature can be obtained. Therefore, it becomes possible to use noble metals as electrode materials—such noble metals as Pt, Ru, Rh, Pd, W, Re, Os, Ir and Au.

The above-mentioned PTC thermistor unit is of such a lamination structure that the PTC thermistor film is sandwiched between a pair of electrodes. It may also be so arranged that one of the electrodes and the PTC thermistor film are placed on the p-type semiconductor layer formed on the same side of the substrate while the other electrode is put on the PTC thermistor film. Another arrangement is that one electrode is provided on a side of a substrate made of a p-type semiconductor and a PTC thermistor film with another electrode provided thereon is provided on an opposite side of the substrate. That is, the both electrodes are arranged so as to face each other via the substrate.

Of the electrodes, the one that 1s formed after the formation of the PTC thermistor film may be made of aluminum, nickel, In—Hg alloys and In—Ga alloys.

The aforesaid p-type semiconductor may be semiconductors formed with the main component being silicon, nickel oxide, cobalt oxide, iron oxide, manganese oxide, bismuth oxide or chromium oxide.

While the novel features of the invention are set forth particularly in the appended claims, the invention, both as to organization and content, will be better understood and appreciated, along with other objects and features thereof, from the following detailed description taken in conjunction with the drawings

BRIEF DESCRIPTION OF THE SEVERAL VIEWS OF THE DRAWING

FIG 7A shows a state when one electrode is formed on a substrate. FIG. 7B shows a state when a PTC thermistor film being formed on the electrode FIG. 7C shows a state when the other electrode being formed thereon.

DETAILED DESCRIPTION OF THE INVENTION

Figure 1:
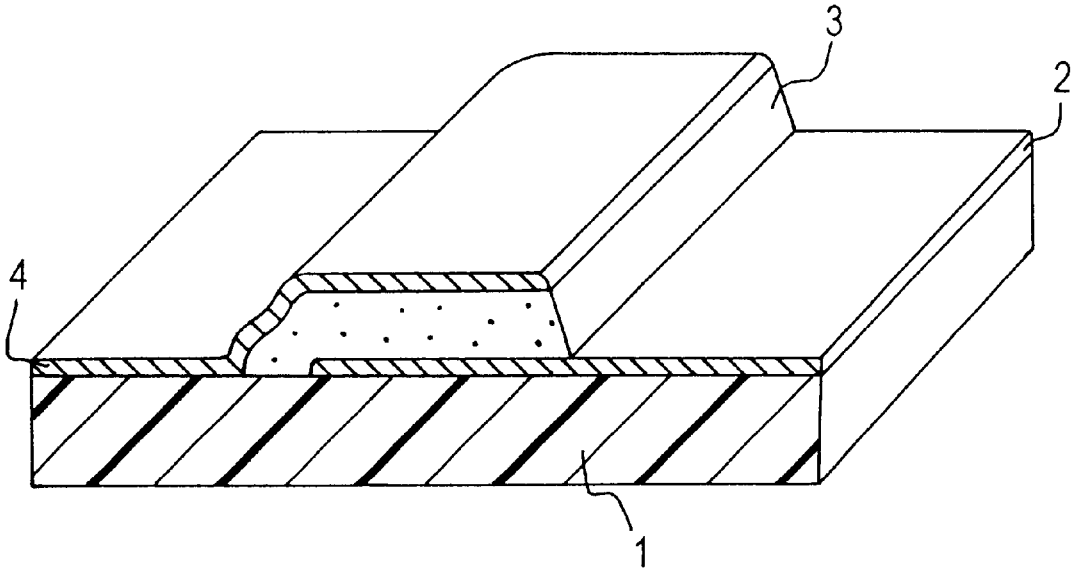
FIG. 1 is a perspective view of a PTC thermistor element of the lamination structure.

In the following paragraphs, preferred examples of the present invention will be described with reference to the attached drawings.

EXAMPLE 1

In the present embodiment, an explanation will be made on an improved method for making the PTC thermistor of the lamination structure shown in FIG. 1.

The PTC thermistor element shown in FIG. 1 was produced in the following way.

A thin nickel film of 0.2 μm thick in a specific configuration was formed on a substrate 1 of alumina of 5 mm width and 10 mm length by the sputtering technique, thus obtaining an electrode 2. The temperature of the substrate 1 was set at 150° C. during the formation. Then a PTC thermistor film 3 in a specific configuration was formed on the electrode by the rf magnetron sputtering method using a ceramic target of $Ba_{0.77}Sr_{0.23}Y_{0.002}Mn_{0.007}O_3$.

In this process, the temperature of the substrate 1 was set at 350° C., and a mixed gas of Ar and $O_2$ ($Ar/O_2$)=9.5/0.5) was introduced into the system. The degree of vacuum was set at 1 Pa; the rf power at 150 W; the film forming time at one hour. A thickness of the PTC thermistor film 3 obtained was 2 μm.

The substrate 1 thus obtained was heated by using a lamp heater under an oxygen atmosphere. Six seconds after turning the lamp heater on, the substrate 1 was heated up to 1,200° C. The substrate 1 was held for 30 seconds at 1,200° C. and then the lamp heater turned off and the substrate was allowed to be cooled. Six seconds after turning the lamp heater off, the substrate 1 was cooled down to room temperature. This cycle of heat treatment was repeated 10 times.

Then. an electrode 4 of aluminum of 0.2 μm thick was formed in a specific configuration on the PTC thermistor film 3 to produce a PTC thermistor element. It is noted that a metal mask was used in forming each film. The area in which the two electrodes were faced with each other was set to 25 $mm^2$.

As a comparative example, a PTC thermistor film formed in the same way was heated under an oxygen atmosphere In an electric furnace for 9 hours to produce a similar PTC thermistor element. In the electric furnace, the substrate was heated up to 800° C. at the rate of 200° C./hour and maintained at that temperature for one hour. Then, the substrate was allowed to cool down to room temperature in the electric furnace. This shall be called "Comparative Example 1A".

Figure 10:
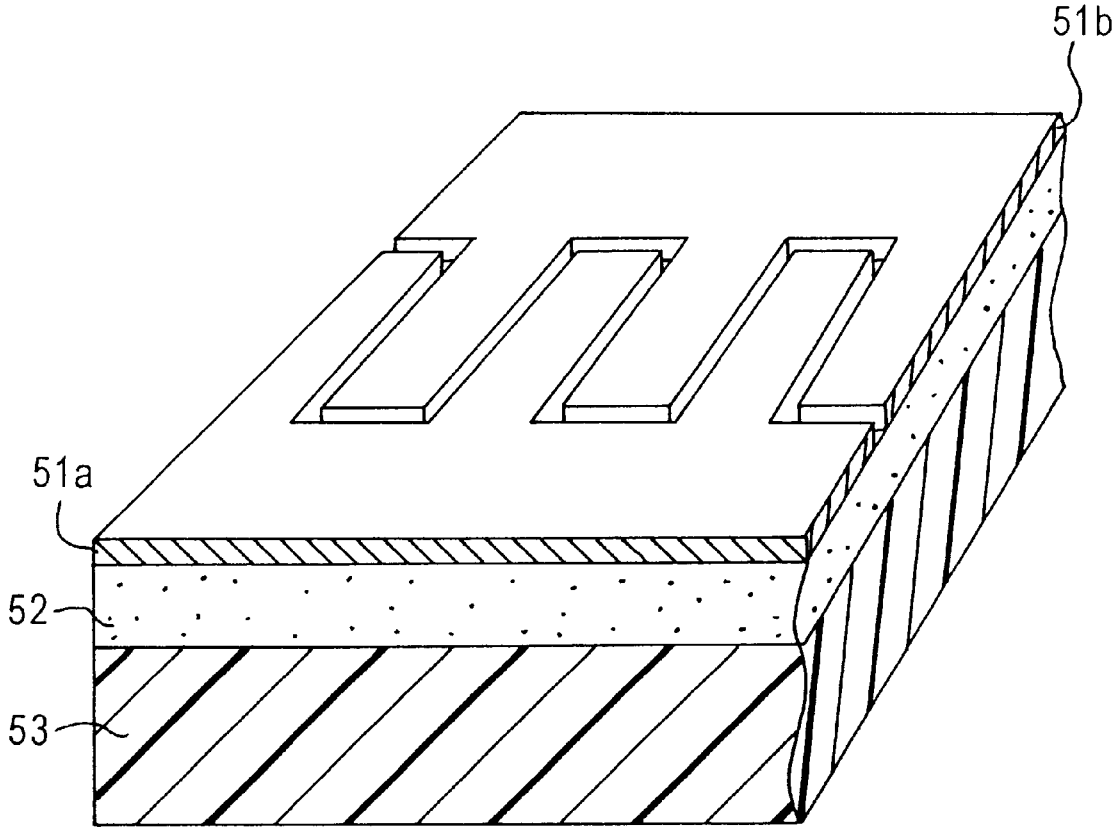
FIG. 10 is a perspective view of the main part of a prior art PTC thermistor element.

Likewise, a PTC thermistor element as another comparative example was constructed using comb-shaped electrodes as shown in FIG. 10 in the following way.

A PTC thermistor film 3 was formed on an alumina substrate 1 of 5 mm width and of 10 mm length by the rf magnetron sputtering technique in the same way as in Example 1 to form a PTC thermistor film 3. The PTC thermistor film thus formed was heated for 9 hours under an oxygen atmosphere in the electric furnace in the same way as in Comparative Example 1. Then an aluminum film of 0.2 μm thick was formed on the PTC thermistor film by the vacuum deposition method using a metal mask. The aluminum film thus formed was processed by photoLithography into comb-shaped electrodes 51*a* and 51*b* to obtain a PTC thermistor element. The comb-shaped electrodes 51*a* and 51*b* both had 10 teeth, each 5 min long and 0.35 mm wide, and the two combs separated by 8.0 μm from each other. This shall be called "Comparative Example 1B".

The PTC thermistor thus obtained were put to tests to study their PTC characteristics. Here, it was impossible to measure the resistance value of Comparative Example 1A, because nickel in the electrode 2 diffused into the PTC thermistor film 3. The measurements of the element of Example 1 and that of Comparative Example 1B are shown in FIG. 2.

Figure 2:
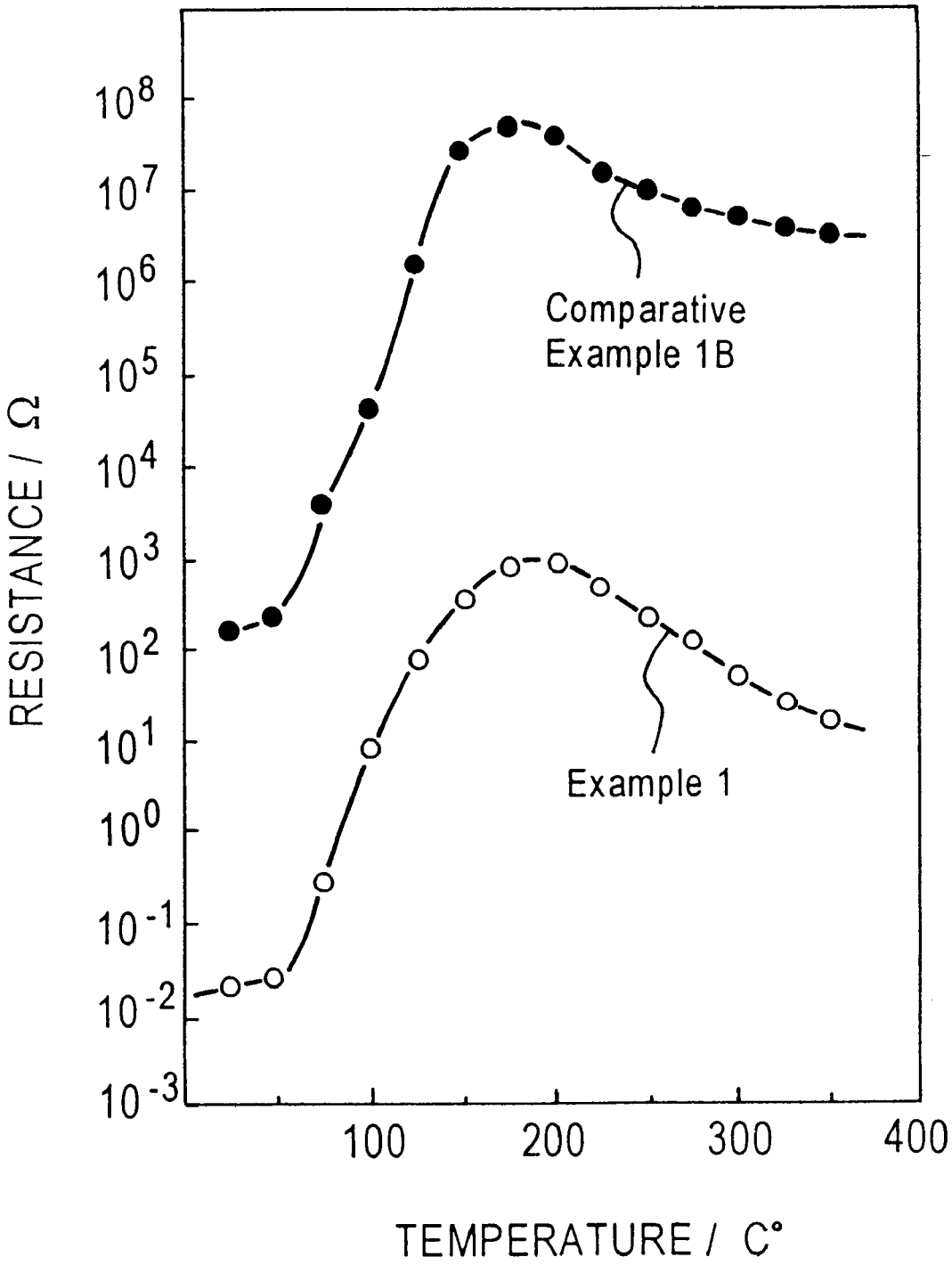
FIG 2 is a characteristic diagram showing PTC characteristics of a PTC thermistor element in an embodiment of the present invention.

As shown in FIG. 2, the PTC thermistor element of the present embodiment exhibits good PTC characteristics and low electric resistance at room temperature as compared with the prior art PTC thermistor element (Comparative Example 1B)

EXAMPLE 2

In the present embodiment, an explanation will be made on an improvement in structure of a PTC thermistor element.

Figure 3:
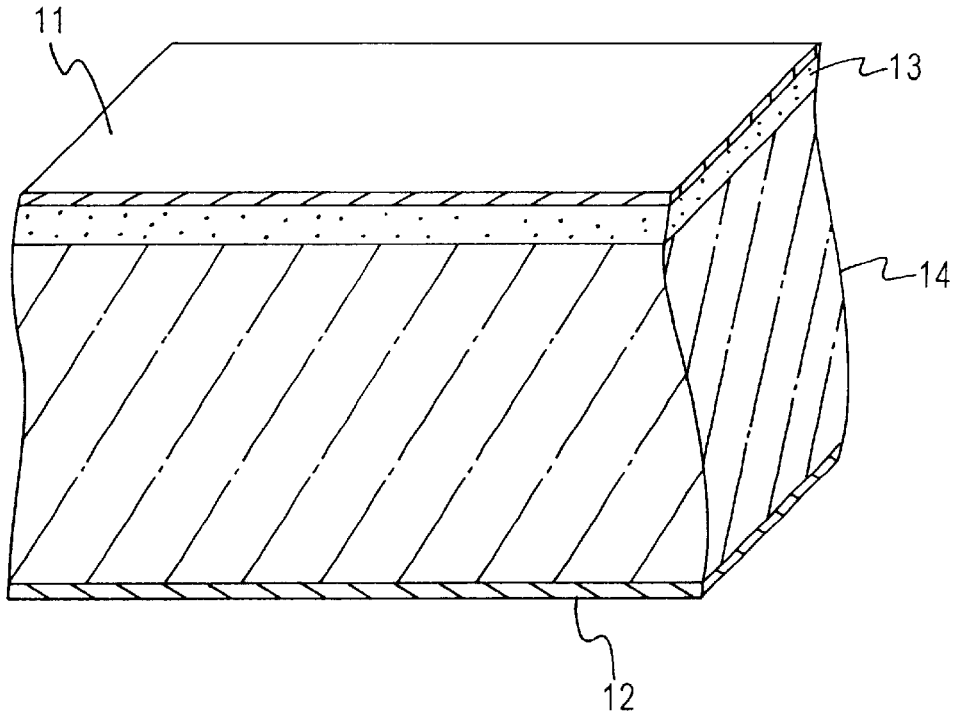
FIG. 3 is a perspective view of the main part of a PTC thermistor element in another embodiment.

The outline of the structure of the PTC thermistor is shown in FIG. 3.

In the present example, a 2.5 μm-thick PTC thermistor film 13 containing barium titanate as a main component is formed on one side of an n-type semiconductor substrate 14 also containing barium titanate as a main component (yttrium-doped barium titanate sintered block of 0.3 mm thick and 3 ohms cm in specific resistance). A 0.2 μm-thick electrode 11 made of an aluminum film is formed on the PTC thermistor film 13. On the other side of the n-type semiconductor substrate 14, also, there is formed an electrode 12 of a 0.2 μm-thick aluminum film. This PTC thermistor element was prepared in the following way.

First, the PTC thermistor 13 was formed on the n-type semiconductor substrate 14 by the rf magnetron sputtering method under the following conditions.

TABLE 1

| |
|---|
| Target: sintered block of barium titanium ($Ba_{0.77}Sr_{0.23}Ti_{1.02}Y_{0.004}Mn_{0.03}Si_{0.007}O_3$) |
| Substrate temperature: 300° C. |
| Gas fed: |
| argon (flow rate: 10 SCCM) and |
| Oxygen (flow rate: 1 SCCM) |
| Gas pressure in sputtering: 1 Pa |
| Rf power: 150 W |
| Rotation of substrate: 25 rpm |
| Sputtering duration: 120 minutes |

The formed film was heat-treated under the atmosphere for three hours at 1,000° C.

Then, the electrodes 11 and 12 were each formed by the vacuum deposition method with the substrate temperature also raised to 150° C., to obtain a PTC thermistor element. An area of the PTC thermistor film 13, which was sandwiched between the upper and lower electrodes 11 and 12, was set at 10 $mm^2$.

EXAMPLE 3

Figure 4:
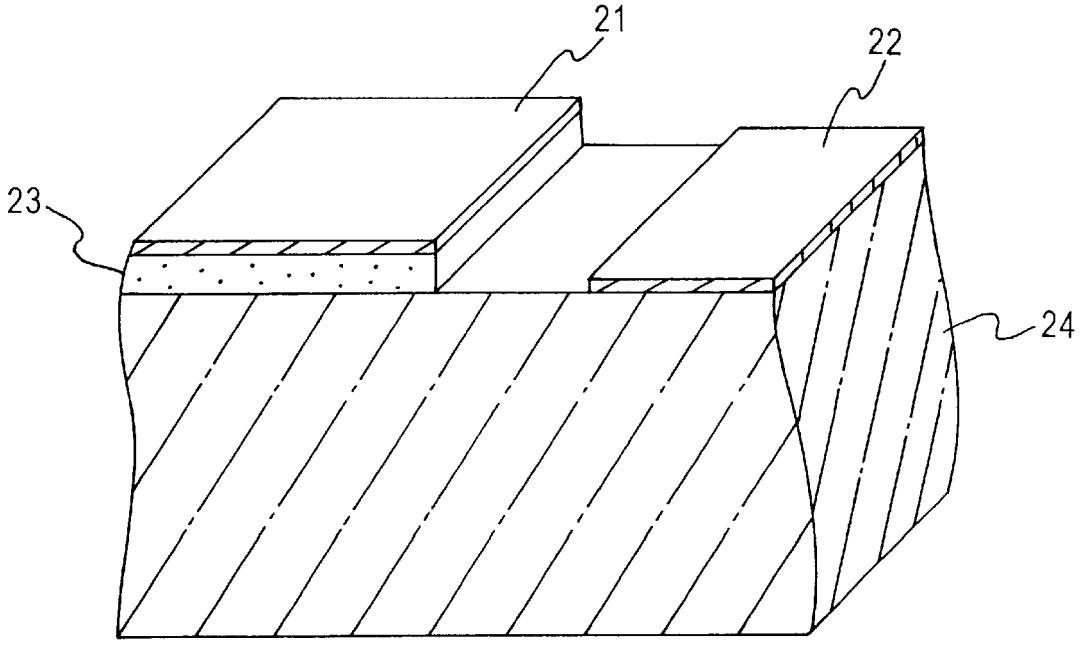
FIG. 4 is a perspective view of the main part of a PTC thermistor element in still another embodiment.

The PTC thermistor element of this example is shown in FIG 4.

A PTC thermistor element of the present example has a 2.5 μm-thick n-type PTC thermistor film 23 containing barium titanate as a main component is formed on one side of a semiconductor substrate 24 also containing barium tltanate as a main component, as same as the PTC thermistor element of Example 2. On the PTC thermistor film 23 is formed an electrode 21 made of 0.2 μm-thick aluminum film On the same side of the n-type semiconductor substrate 24, in addition, there is formed an electrode 22 made of a 0.2 μm-thick aluminum film.

This PTC thermistor element was prepared in the following manner.

The PTC thermistor film 23 was formed on a part (a rectangular area of 5 mm ×1 mm) of one side of the n-type semiconductor substrate 24 by the rf magnetron sputtering method. As in the element of Example 2, the target was a sintered block of the barium titanate with a composition of: $Ba_{0.77}Sr_{0.23}Ti_{1.02}Y_{0.004}Mn_{0.03}Si_{0.007}O_3$.

The other sputtering conditions were also the same as those in Example 2.

Then, a 0.2 μm-thick aluminum film was formed on the PTC thermistor film 23 by the vacuum deposition method using a metal mask, to obtain the electrode 21 with a 5 $mm^2$ area (a rectangular area of 5 mm ×1 mm). In another area on the surface of the n-type semiconductor substrate 24, a 0.2 μm-thick aluminum film was formed to produce the electrode 22 (a 5 $mm^2$ rectangular area of 5 mm ×1 mm). The substrate temperature in the film-forming step was all set at 150° C.

EXAMPLE 4

Figure 5:
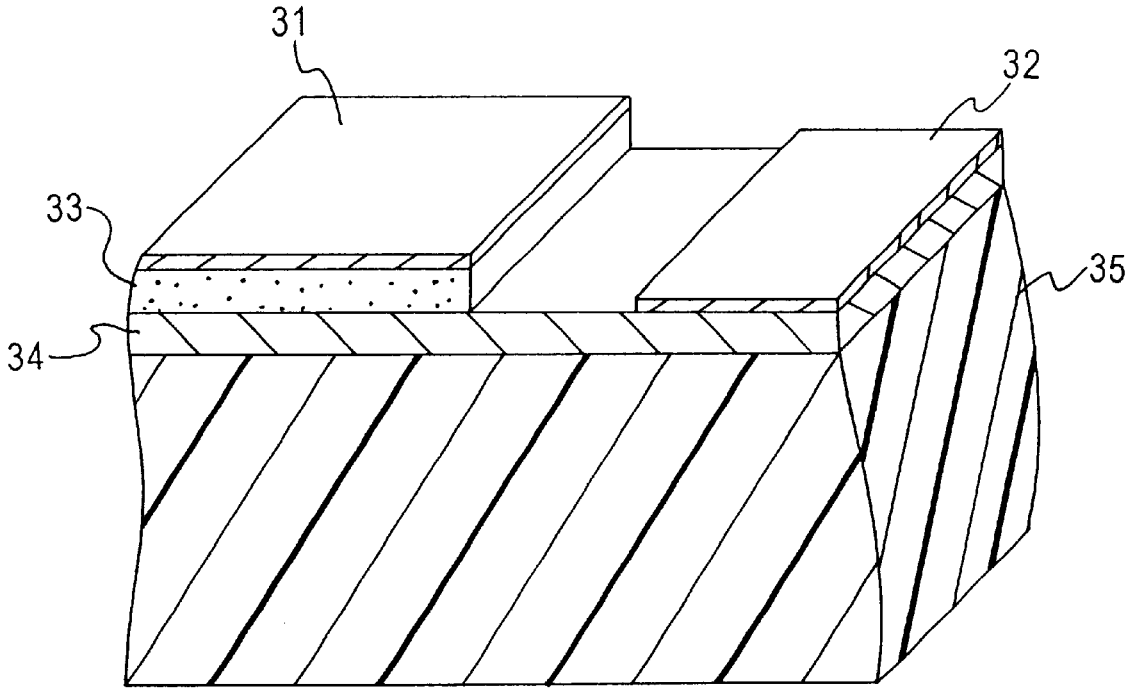
FIG. 5 is a perspective view of the main part of a PTC thermistor element in a further embodiment.

The PTC thermistor element of the present example is illustrated in FIG. 5.

A 10 μm-thick n-type semiconductor film 34 containing barium titanate as a main component is formed on one side of an alumina substrate 35 as used in Example 1. On the n-type semiconductor film 34 is formed a 2.5 μm-thick PTC thermistor film 33 also containing barium titanate as a main component. On the other side of the PTC thermistor film 33 is formed an electrode 31 made of a 0.2 μm-thick aluminum film. In another area on the same side of the n-type semiconductor film 34, there is formed an electrode 32 made of a 0.2 μm-thick aluminum film.

This PTC thermistor element was prepared in the following manner.

First, a 2.0 μm-thick n-type semiconductor film 34 was formed on the alumina substrate 35 by the rf magnetron sputtering method under the following conditions.

TABLE 2

| |
|---|
| Target: sintered block of barium titanium ($Ba_{0.77}Sr_{0.23}Ti_{1.02}Y_{0.004}Mn_{0.03}Si_{0.007}O_3$) |
| Substrate temperature: 600° C. |
| Gas fed: |
| argon (flow rate: 10 SCCM) and oxygen (flow rate: 0.55 SCCM) |
| Gas pressure in sputtering: 1 Pa |
| rf power: 150 W |
| Rotation of substrate: 25 rpm |
| Sputtering duration: 100 minutes |

Then, the film thus formed was heat-treated for two hours at 1,300° C.

This sputtering and heat treatment were repeated further four times so as to make the thickness of the n-type semiconductor film 34 to 10 μm. The specific resistance of the n-type semiconductor film 34 thus obtained, measured by the four probe method, was 0.8 ohms-cm.

The 2.5 μm-thick PTC thermistor film 33 was formed on a part (on a rectangular area of 5 mm ×1 mm) of the surface of the n-type semiconductor film 34 by the rf magnetron sputtering method in the same way as in Example 2.

Then. a 02 μm-thick aluminum film as the electrode 31 was formed on the PTC thermistor film 33 by the vacuum deposition method using a metal mask. Also on the n-type semiconductor film 34, a 0.2 μm-thick aluminum film having a rectangular area 5 mm ×1 mm was formed as the electrode 32 In the same way. The electrode 31 and electrode 32 were separated each other by 0.1 mm. The substrate temperature in the film-forming steps was all set at 150° C.

Figure 6:
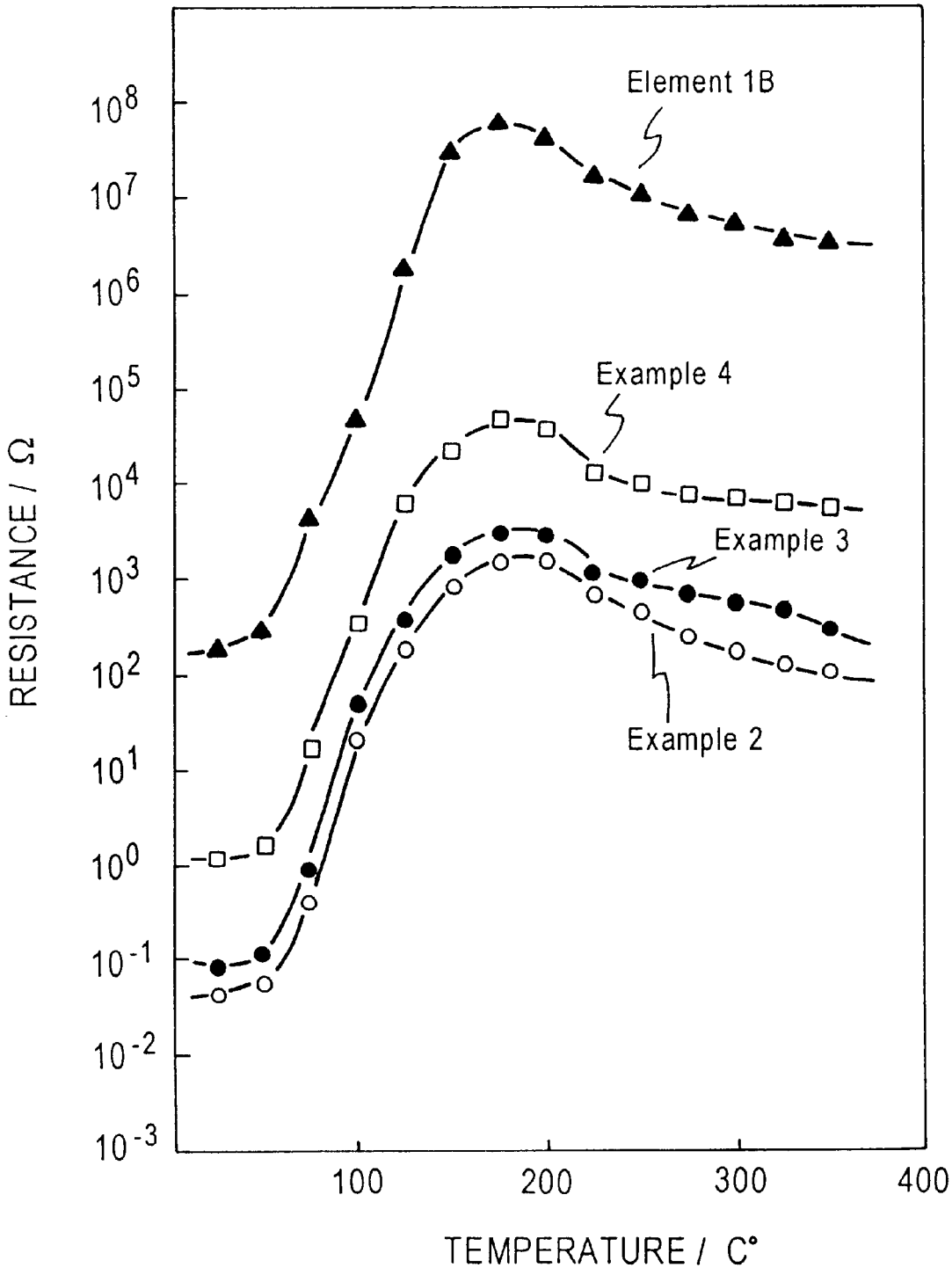
FIG. 6 is a characteristic diagram showing PTC characteristics of the PTC thermistor elements in the embodiments of the present invention.

The PTC characteristics of the PTC thermistor elements obtained in the above Examples 2 to 4 are shown in FIG. 6 along with those of the element 1B prepared as a comparative example in Example 1.

As illustrated in FIG. 6, the PTC thermistor elements of Examples 2 to 4 were all low in electric resistance at room temperature and the value is $10^{-3}$ to $10^{-2}$ times of the value of the element 1B. Especially, the PTC thermistor elements of Examples 2 and 3 in which the PTC thermistor film Is sandwiched between a pair of electrodes are low in electric resistance. In other characteristics, the PTC thermistor elements of Examples 2 to 4 are about equal to the element 1B in the rate of change in electric resistance before and after the Curie point. A probable explanation for the low electric resistance of the PTC thermistor elements of Examples 2 to 4 is that the electric current path runs in the direction of film thickness as against the direction parallel with the substrate in the prior art element.

EXAMPLE 5

In the present embodiment, there will be explained a PTC thermistor element in which heat-resistant noble metals can be used in the electrode.

As mentioned above, noble metals such as platinum are excellent in heat resistance, and electrodes of those materials cause no worry about such problems as oxidation and atom diffusion in the step of forming PTC thermistor film. But the trouble is that a shottky barrier will be formed between the electrode and the PTC thermistor film, and an ohmic connection is impossible. In a case, therefore, an electric current runs from the PTC thermistor film to the electrode through the shottky barrier, the electric resistance value will rise temporarily or when the electric current is low. That is, the same rectification characteristics as diode are exhibited due the formation of shottky barrier.

In the present embodiment, th(ere will be described a PTC thermistor element which exhibits excellent PTC characteristics even if noble metals are used as the electrode material.

Figure 7A:
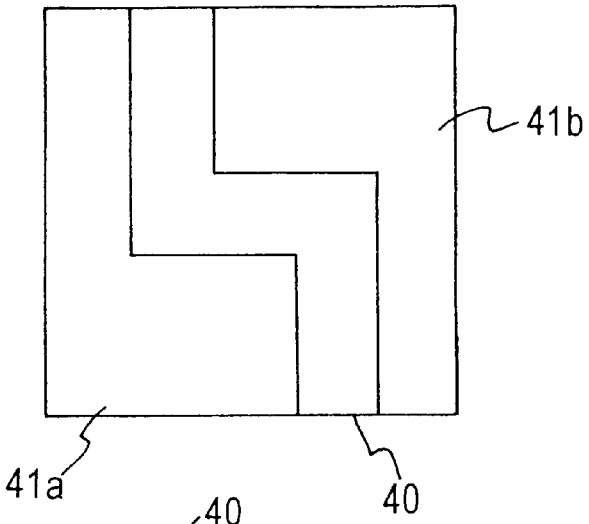
FIG. 7A, FIG. 7B and FIG. 7C are explanatory diagrams at different stages in production of a PTC thermistor element in a still further embodiment.
Figure 7B:
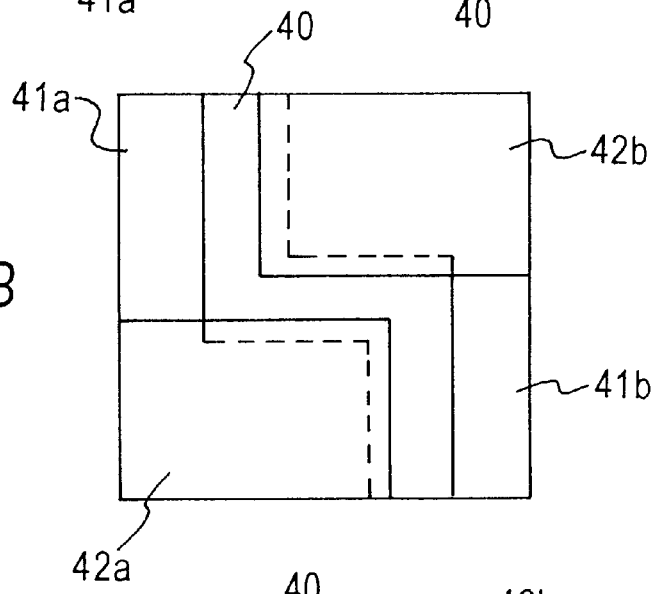
Figure 7C:
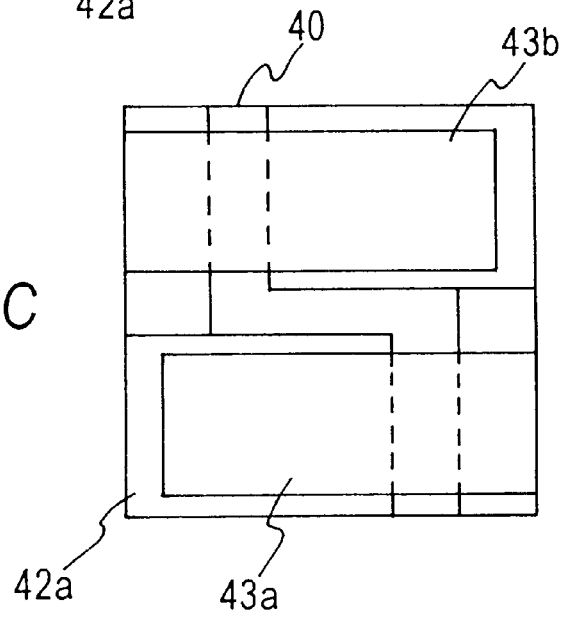

First, electrodes 41*a* and 41*b* made of a noble metal are formed on an insulating substrate 40 as illustrated in FIG. 7A. In the next step, PTC thermistor films 42*a* and 42*b* are formed on the noble metal electrodes 41*a* and 41*b*. respectively, as shown in PIG. 7E. On top of that, base metal electrodes 43*a* and 43*b* are so formed that the PTC thermistor films 42*a* and 42*b* are connected with the noble metal electrodes 41*b* and 41*a* which have been connected to the other PTC thermistor films, respectively, as shown in FIG. 7C.

A 20 mm-square surface of an alumina substrate 40 was divided into 16 equal sections. On each section, a pair of 0.2 μm-thick platinum films were formed as electrodes 41*a* and 41*b* in the pattern shown in FIG. 7A by the rf magnetron sputtering method using a metal mask under the following condition. Here, the electrodes 41*a* and 41*b* were separated by 1 mm.

TABLE 3

| |
|---|
| Target: platinum (5 inches in diameter) |
| Substrate temperature: 200° C. |
| Gas fed: argon (flow rate: 10 SCCM) |
| Gas pressure in sputtering: 1 Pa |
| Rf power: 100 W |
| Rotation of substrate: 25 rpm |
| Sputtering duration: 10 minutes |

Those platinum electrodes 41*a* and 41*b* were heat-treated in the atmosphere for three hours at 1.000° C.

On the upper side of the platinum electrodes 41*a* and 41*b* thus obtained, the 2.5 μm-thick PTC thermistor films 42*a* and 42*b* were formed by the rf magnetron sputtering method under the following conditions.

TABLE 4

| |
|---|
| Target: sintered block of barium titanium ($Ba_{0.77}Sr_{0.23}Ti_{1.02}Y_{0.004}Mn_{0.03}Si_{0.007}O_3$) |
| Substrate temperature: 400° C. |
| Gas fed: |
| argon (flow rate: 10 SCCM) and oxygen (flow rate: 1 SCCM) |
| Gas pressure in sputtering: 1 Pa |
| Rf power: 150 W |
| Rotation of substrate: 25 rpm |
| Sputtering duration: 120 minutes |

Figure 8:
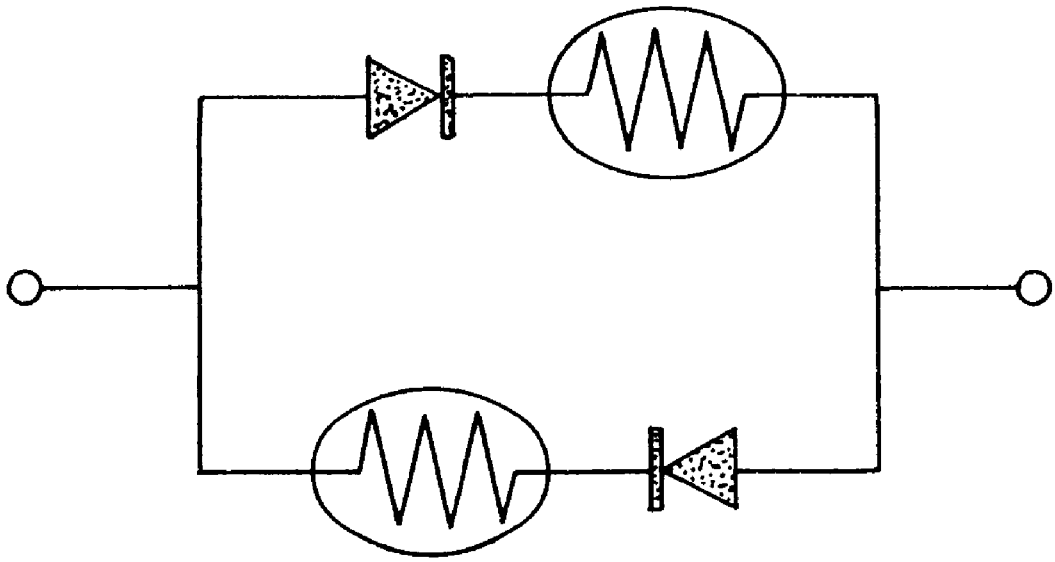
FIG. 8 is a block diagram showing an equivalent circuit of the same PTC thermistor element.

The PTC thermistor films 42*a* lad 42*b* thus obtained were heat-treated in the atmosphere for two hours at 1,000° C. On top of that, a 0.2 μm-thick aluminum film as the electrode 43*a* was so formed that the PTC thermistor film 42*a* might be connected with the noble metal electrode 41*b* which had been connected with the PTC thermistor film 42*b*. Likewise, a 0.2 μm-thick aluminum film as the electrode 43*b* was so formed that the PTC thermistor film 42*b* might be connected with the noble metal electrode 41*a* which had been connected with the PTC thermistor film 42*a*. The parts of the PTC thermistor films 42*a* and 42*b* being sandwiched between the upper and lower electrodes were each 5 mm The substrate temperature was set at 150° C. at that time The PTC thermistor element thus obtained is provided with a number of PTC thermistor element units of the same construction, all parallel-connected to each other, with at least one of them placed in reverse manner. An equivalent circuit of that element unit is shown in FIG. 8.

As a comparison. a PTC thermistor of the lamination structure shown in FIG. 1 was produced using platinum used as the material for the lower electrode 4. The thickness of the PTC thermistor film 3 was set at 2.5 μm— the same as with the PTC thermistor element of Example 5—, and the PTC thermistor film 3 sandwiched between the electrodes 2 and 4 was set to 5 $mm^2$. This shall be called element 5A.

Figure 9:
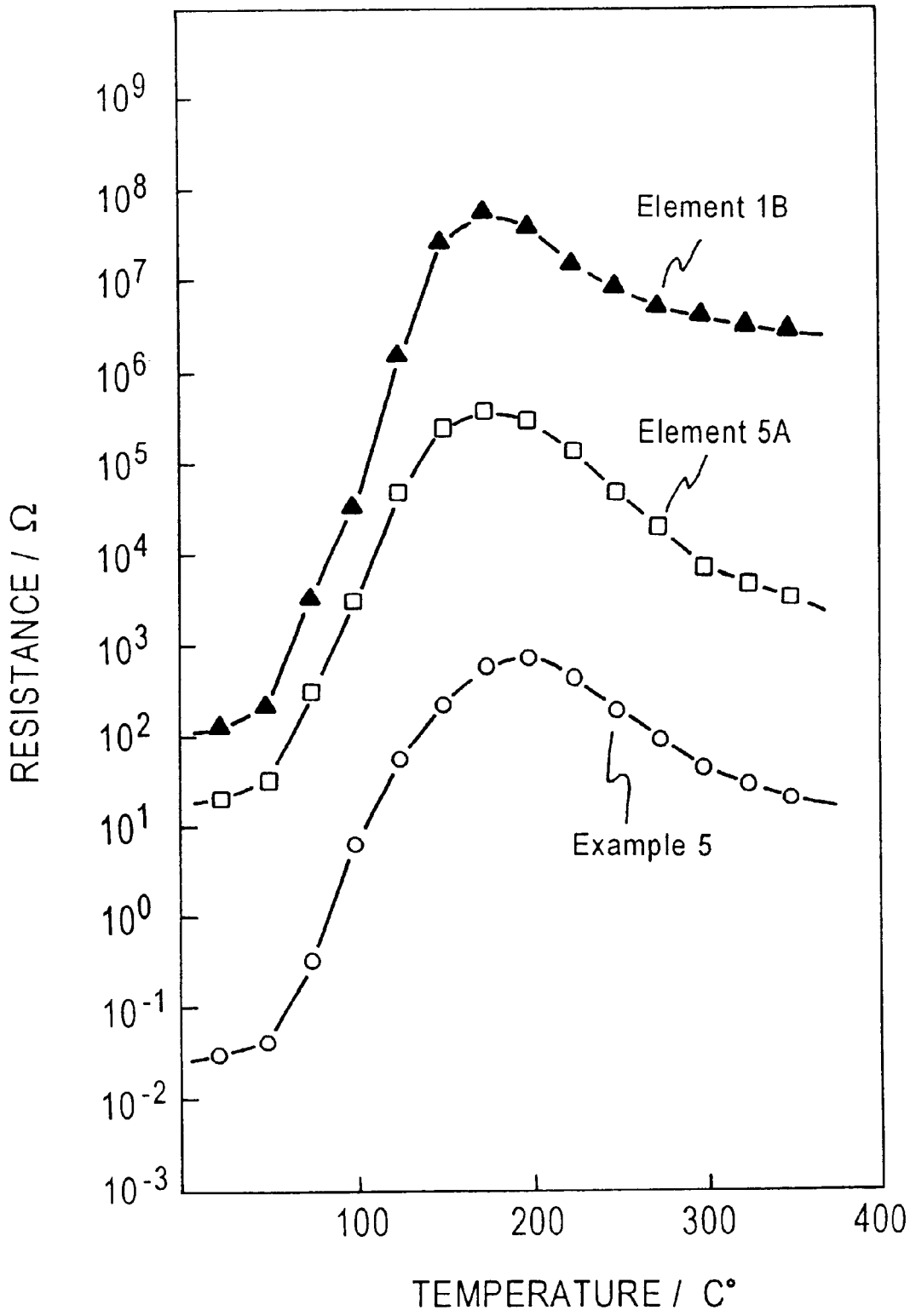
FIG. 9 is a characteristic diagram showing PTC characteristics of the same PTC thermistor element.

The PTC characteristics of those PTC thermistor elements are shown in FIG. 9. For further comparison, the PTC characteristics of the element 1B used in Example 1 are also shown in the figures.

As is evident from FIG. 9, the PTC thermistor element of the present embodiment is superior to the comparative elements 5A and 1B in PTC characteristics.

The comparative element 5A exhibits rectification characteristics because of the formation of a shottky barrier, raising the electric resistance. The PTC thermistor element of the present embodiment in which at least one of a number of parallel-connected element units of the same construction is placed in reverse manner can keep down rectification characteristics. Needless to say, the PTC thermistor element of the present embodiment can lower the resistance far more than the element 18 provided with comb-shaped electrodes.

It is understood that various other modifications will be apparent to, and can be readily made by, those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A PTC thermistor element comprising:

a PTC thermistor film containing barium titanate;

an n-type semiconductor contacting said PTC thermistor film;

a first electrode connected to said PTC thermistor film; and a second electrode connected to said n-type semiconductor.

2. The PTC thermistor element in accordance with claim 1, wherein said PTC thermistor film and said first electrode are laminated on one side of a substrate made of said n-type semiconductor and said second electrode is provided on the opposite side of said substrate.

3. The PTC thermistor of claim 2, wherein said second electrode contacts said substrate.

4. The PTC thermistor element in accordance with claim 1, wherein said PTC thermistor film and said first electrode are laminated on a part of one side of a substrate made of said n-type semiconductor, and said second electrode is provided on another part of the same side of said substrate.

5. The PTC thermistor of claim 4, wherein said second electrode contacts said substrate.

6. The PTC thermistor element in accordance with claim 1, further comprising an insulating substrate, wherein said n-type semiconductor is a film formed on the surface of said insulating substrate, said PTC thermistor film and said first electrode are laminated on a part of the outer surface of said n-type semiconductor film, and said second electrode is provided on another part of said outer surface of the film.

7. The PTC thermistor element in accordance with claim 1, wherein said n-type semiconductor contains a barium titanate having the perovskite crystal structure.

8. A PTC thermistor element comprising:

a plurality of PTC thermistor units, each of said units including: a pair of electrodes and a PTC thermistor film containing barium titanate connected to both of said electrodes, wherein at least one of said units is a PTC thermistor element in accordance with claim 1, and a substrate connected to each of said units, wherein said units are parallel-connected to each other, and at least one unit of said plurality of units is placed in a reverse manner with respect to the arrangement of an other unit such that current flowing in said at least one unit is in a direction opposite to a current flowing in said other unit.

9. The PTC thermistor element in accordance with claim 8, wherein said PTC thermistor film is sandwiched between a pair of electrodes, and one of said electrodes is connected to said substrate.

10. The PTC thermistor element in accordance with claim 8, wherein said substrate is provided with a p-type semiconductor layer on the side where said PTC thermistor unit is provided, one of said electrodes and PTC thermistor film are provided in a different area on said p-type semiconductor layer, and the other electrode is provided on said PTC thermistor film.

11. The PTC thermistor element in accordance with claim 8, wherein said substrate is made of a p-type semiconductor, one of said electrodes and PTC thermistor film are provided on opposing sides of said substrate with said substrate therebetween, and the other electrode is formed on said PTC thermistor film.

* * * * *

UNITED STATES PATENT AND TRADEMARK OFFICE

CERTIFICATE OF CORRECTION

PATENT NO. : 6,462,643 B1
DATED : October 8, 2002
INVENTOR(S) : Eiji Rujii et al.

It is certified that error appears in the above-identified patent and that said Letters Patent is hereby corrected as shown below:

Title page,
Delete "[*] Notice: This patent issued on a continued prosecution application filed under 37 CFR 1.53(d), and is subject to the twenty year patent term provisions of 35 U.S.C. 154(a)(2)."

Signed and Sealed this

Ninth Day of December, 2003

JAMES E. ROGAN
*Director of the United States Patent and Trademark Office*